US005451712A

United States Patent [19]

Lee

[11] Patent Number: 5,451,712

[45] Date of Patent: Sep. 19, 1995

[54] POSITIONAL EFFECT SOUND GENERATION APPARATUS FOR ELECTRONIC MUSICAL INSTRUMENT

[75] Inventor: Kyung W. Lee, Seoul, Rep. of Korea

[73] Assignee: Goldstar Co., Ltd., Seoul, Rep. of Korea

[21] Appl. No.: 161,726

[22] Filed: Dec. 3, 1993

[30] Foreign Application Priority Data

Dec. 3, 1992 [KR] Rep. of Korea ..... 23196/1992

[51] Int. Cl.[6] ..... G10H 1/043

[52] U.S. Cl. ..... 84/630; 84/477 R; 84/DIG. 26; 381/63

[58] Field of Search ..... 84/630, 477 R, 478, 84/DIG. 6, DIG. 26; 381/63, 61

[56] References Cited

U.S. PATENT DOCUMENTS

| | | | |
|---|---|---|---|
| 4,864,625 | 9/1989 | Hanzawa et al. | 381/61 |
| 4,998,281 | 3/1991 | Sakata | 381/63 |
| 5,081,896 | 1/1992 | Hiyoshi et al. | 84/626 X |
| 5,081,898 | 1/1992 | Fujimori | 84/602 X |
| 5,092,216 | 3/1992 | Wadhams | 84/602 |
| 5,127,306 | 7/1992 | Mitsuhashi et al. | 84/665 |
| 5,153,362 | 10/1992 | Toda et al. | 84/625 |
| 5,159,140 | 10/1992 | Kimpara et al. | 84/DIG. 26 |
| 5,179,238 | 1/1993 | Hotta | 84/478 |

*Primary Examiner*—Stanley J. Witkowski

*Attorney, Agent, or Firm*—Ostrolenk, Faber, Gerb & Soffen

[57] ABSTRACT

A positional effect sound generation apparatus for an electronic musical instrument includes a function selector for selecting a function according to a user's selection, a note sensing circuit for sensing a note corresponding to a key on a keyboard pushed by a performer, a storage unit for storing a plurality of control signals, a CPU for selecting ones of the control signals in the storage unit corresponding to the selected function and the sensed note, a ROM for storing a plurality of sound data, a sound generator for selecting a desired one of the sound data in the ROM in response to the control signal from the CPU and generating a sound signal according to the selected sound data, a sound processing circuit for processing the sound signal from the sound generator and generating an analog echo effect sound signal, a mixer for mixing the processed sound signal with the analog echo effect sound signal, a display controller for controlling a display unit in response to the control signal from the CPU to display a position of a listener on a screen, a positional effect sound generator for applying various positional effects to an output signal from the mixer in response to the control signal from the CPU to generate a positional effect sound, and an amplifier for amplifying the positional effect sound by a predetermined level.

3 Claims, 3 Drawing Sheets

FUNCTION SELECTOR
10
KEY BOARD
20
21
KEYBOARD SENSOR
22
CPU
40
RAM
8
ROM
7
30
DISPLAY CONTROLLER
81
DISPLAY UNIT
82
SOUND GENERATOR
52
ROM
51
FIRST D/A CONVERTER
61
FIRST FILTER
62
ECHO EFFECT SOUND GENERATOR
63
SECOND D/A CONVERTER
64
SECOND FILTER
65
60
MIXER
70
L
R
POSITIONAL EFFECT SOUND GENERATOR
90
AMP
100
SP

FIG. 5

| MSB | | | | | LSB | | | FUNCTION |
|---|---|---|---|---|---|---|---|---|
| 0 | X | B2 | B1 | B0 | A2 | A1 | A0 | VOLUME 0.375 dB Steps |
| | | | | | 0 | 0 | 0 | 0 |
| | | | | | 0 | 0 | 1 | -0.375 |
| | | | | | 0 | 1 | 0 | -0.75 |
| | | | | | 0 | 1 | 1 | -1.125 |
| | | | | | 1 | 0 | 0 | -1.5 |
| | | | | | 1 | 0 | 1 | -1.875 |
| | | | | | 1 | 1 | 0 | -2.25 |
| | | | | | 1 | 1 | 1 | -2.625 |
| 0 | X | B2 | B1 | B0 | A2 | A1 | A0 | VOLUME 3dB Steps |
| | | 0 | 00 | 0 | | | | 0 |
| | | 0 | 0 | 1 | | | | -3 |
| | | 0 | 1 | 0 | | | | -6 |
| | | 0 | 1 | 1 | | | | -9 |
| | | 1 | 0 | 0 | | | | -12 |
| | | 1 | 0 | 1 | | | | -15 |

| MSB | | | | | LSB | | | FUNCTION |
|---|---|---|---|---|---|---|---|---|
| 1 | D3 | D2 | D1 | D0 | C2 | C1 | C0 | |
| | 0 | 0 | 0 | A3 | C2 | C1 | C0 | BAND 1 |
| | 0 | 0 | 1 | A3 | C2 | C1 | C0 | BAND 2 |
| | 0 | 1 | 0 | A3 | C2 | C1 | C0 | BAND 3 |
| | 0 | 1 | 1 | A3 | C2 | C1 | C0 | BAND 4 |
| | 1 | 0 | 0 | A3 | C2 | C1 | C0 | BAND 5 |
| | D3 | D2 | D1 | 1 | C2 | C1 | C0 | CUT |
| | D3 | D2 | D1 | 0 | C2 | C1 | C0 | BOOST |
| | | | | | 0 | 0 | 0 | 0dB |
| | | | | | 0 | 0 | 1 | 2dB |
| | | | | | 0 | 1 | 0 | 4dB |
| | | | | | 0 | 1 | 1 | 6dB |
| | | | | | 1 | 0 | 0 | 8dB |
| | | | | | 1 | 0 | 1 | 10dB |
| | | | | | 1 | 1 | 0 | 12dB |
| | | | | | 1 | 1 | 1 | 14dB |

AX=0.375dB Steps, BX=3dB Steps, CX=2dB Steps, X=Don't care

POSITIONAL EFFECT SOUND GENERATION APPARATUS FOR ELECTRONIC MUSICAL INSTRUMENT

BACKGROUND OF THE INVENTION

1. Field of the Invention

The present invention relates in general to electronic musical instruments, and more particularly to a positional effect sound generation apparatus for an electronic musical instrument, in which a positional effect sound is amplified by different levels according to positions of listeners so that the listeners can equally listen to the positional effect sound regardless of their positions.

2. Description of the Prior Art

In conventional electronic musical instruments, a positional effect sound is generated at a fixed level regardless of positions of listeners. For this reason, the listeners cannot listen equally to the positional effect sound at their positions.

SUMMARY OF THE INVENTION

Therefore, the present invention has been made in view of the above problem, and it is in object of the present invention to provide a positional effect sound generation apparatus for an electronic musical instrument, in which a positional effect sound is amplified by different levels according to positions of listeners so that the listeners can equally listen to the positional effect sound regardless of their positions.

In accordance with the present invention, the above and other objects can be accomplished by a provision of a positional effect sound generation apparatus for an electronic musical instrument, comprising function selection means for selecting a function according to a user's selection; note sensing means for sensing a note corresponding to a key on a keyboard pushed by a performer; first storage means for storing a plurality of control signals; central processing means for selecting ones of the control signals in said first storage means corresponding to the function selected by said function selection means and the note sensed by said note sensing means and outputting the selected control signals; second storage means for storing a plurality of sound data; sound generation means for selecting a desired one of the sound data in said second storage means in response to the control signal from said central processing means and generating a sound signal according to the selected sound data; sound processing means for processing the sound signal from said sound generation means and generating an analog echo effect sound signal; mixing means for mixing the sound signal processed by said sound processing means with the analog echo effect sound signal therefrom; display control means for controlling a display unit in response to the control signal from said central processing means to display a position of a listener on a screen; positional effect sound generation means for applying various positional effects to an output signal from said mixing means in response to the control signal from said central processing means to generate a positional effect sound; and amplification means for amplifying the positional effect sound from said positional effect sound generation means by a predetermined level and outputting the amplified positional effect sound through a speaker.

BRIEF DESCRIPTION OF THE DRAWINGS

The above and other objects, features and advantages of the present invention will be more clearly understood from the following detailed description taken in conjunction with the accompanying drawings, in which:

FIG. 5 is a data format of the control signal for the generation of the positional effect sound in the positional effect sound generation apparatus in FIG. 1.

DETAILED DESCRIPTION OF THE PREFERRED EMBODIMENT

Figure 1:
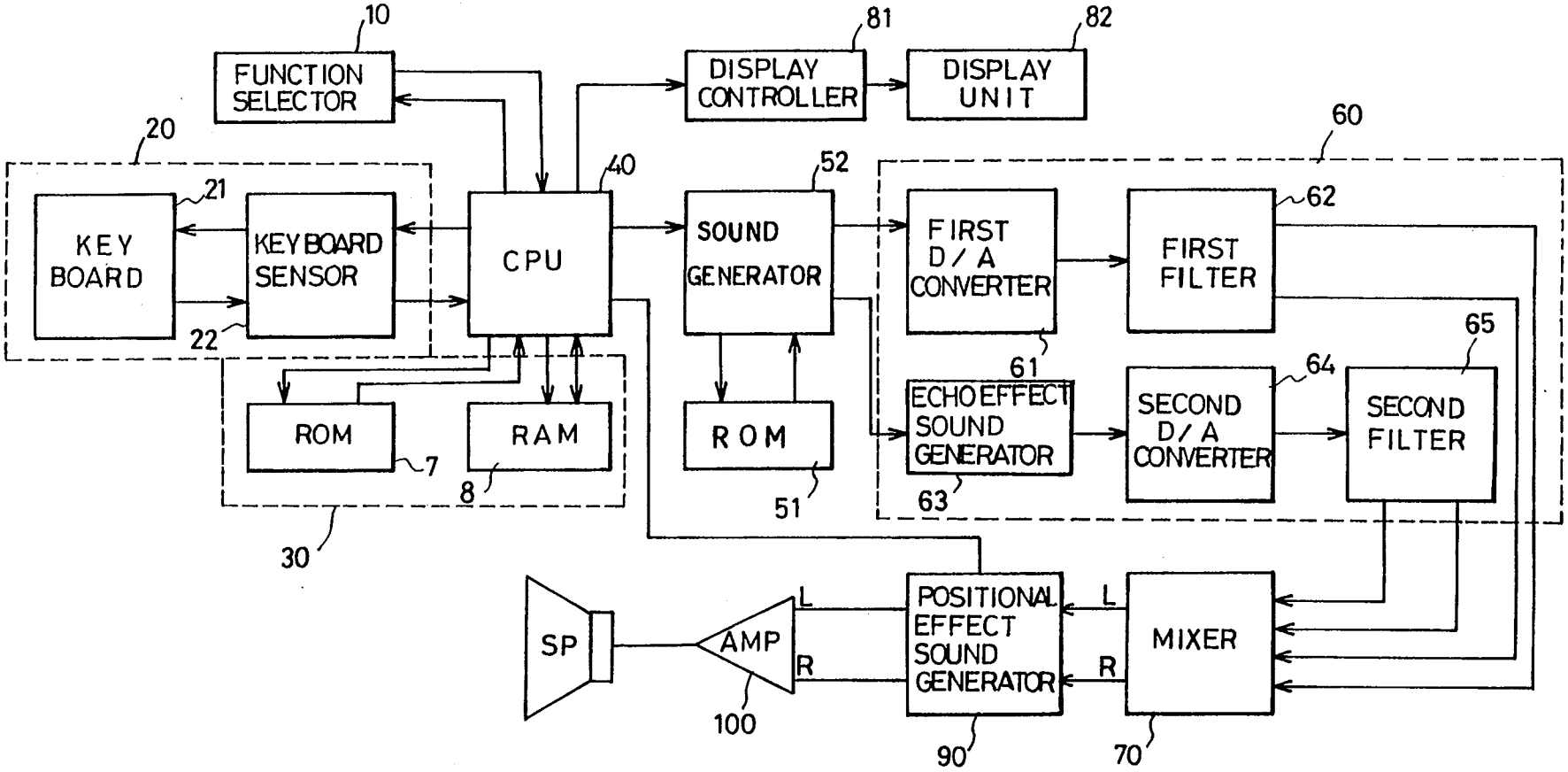
FIG. 1 is a block diagram of a positional effect sound generation apparatus for an electronic musical instrument in accordance with the present invention.

Referring to FIG. 1, there is shown a block diagram of a positional effect sound generation apparatus for an electronic musical instrument in accordance with the present invention. As shown in this drawing, the positional effect sound generation apparatus comprises a function selector 10 for selecting a function according to a user's selection, a note sensing circuit 20 for sensing a note corresponding to a key on a keyboard 21 pushed by a performer, a storage unit 30 for storing a plurality of control signals, and a central processing unit (CPU) 40 for selecting ones of the control signals in the storage unit 30 corresponding to the function selected by the function selector 10 and the note sensed by the note sensing circuit 20 and outputting the selected control signals.

A read only memory (ROM) 51 is provided in the positional effect sound generation apparatus to store a plurality of sound data.

A sound generator 52 is also provided in the positional effect sound generation apparatus to select a desired one of the sound data in the ROM 51 in response to the control signal from the CPU 40 and generate a sound signal according to the selected sound data.

A sound processing circuit 60 is adapted to process the sound signal from the sound generator 52 and generate an analog echo effect sound signal.

The positional effect sound generation apparatus also comprises a mixer 70 for mixing the sound signal processed by the sound processing circuit 60 with the analog echo effect sound signal therefrom, a display controller 81 for controlling a display unit 82 in response to the control signal from the CPU 40 to display a position of a listener on a screen, a positional effect sound generator 90 for applying various positional effects to an output signal from the mixer 70 in response to the control signal from the CPU 40 to generate a positional effect sound, and an amplifier 100 for amplifying the positional effect sound from the positional effect sound generator 90 by a predetermined level and outputting the amplified positional effect sound through a speaker SP.

The note sensing circuit 20 includes a keyboard sensor 22 for sensing the note corresponding to the key on the keyboard 21 pushed by the performer, in addition to the keyboard 21.

The sound processing circuit 60 includes a first digital/analog (D/A) converter 61 for converting the sound signal from the sound generator 52 into an analog sound signal, a first filter 62 for wave-shaping the analog sound signal from the first D/A converter 61, an echo effect sound generator 63 for generating an echo effect sound, a second D/A converter 64 for converting the echo effect sound from the echo effect sound generator 63 into the analog echo effect sound signal, and a second filter 65 for wave-shaping the analog echo effect sound signal from the D/A converter 64.

The operation of the positional effect sound generation apparatus with the above-mentioned construction in accordance with the present invention will hereinafter be described in detail with reference to FIGS. 1 to 5.

When a function is selected by the function selector 10 according to the user's selection, the corresponding signal is applied from the function selector 10 to the CPU 40. Also, the note corresponding to the key on the keyboard 21 pushed by the performer is sensed by the keyboard sensor 22 and then applied to the CPU 40.

The CPU 40 selects ones of the control signals in the storage unit 30 corresponding to the function selected by the function selector 10 and the note sensed by the note sensing circuit 20 and outputs the selected control signals.

In response to the control signal from the CPU 40, the sound generator 52 selects a desired one of the sound data in the ROM 51 and generates the sound signal according to the selected sound data. The sound signal from the sound generator 52 is processed by the sound processing circuit 60 so that it is listenable.

Namely, the sound signal from the sound generator 52 is converted into the analog sound signal by the first D/A converter 61 and then wave-shaped by the first filter 62. Also, the echo effect sound is generated from the echo effect sound generator 63 and then converted into the analog echo effect sound signal by the second D/A converter 64. The analog echo effect sound signal from the D/A converter 64 is wave-shaped by the second filter The analog sound signal from the first filter 62 and the analog echo effect sound signal from the second filter 65 are mixed by the mixer 70 and then outputted as audio signals L and R through the speaker SP.

Figure 2:
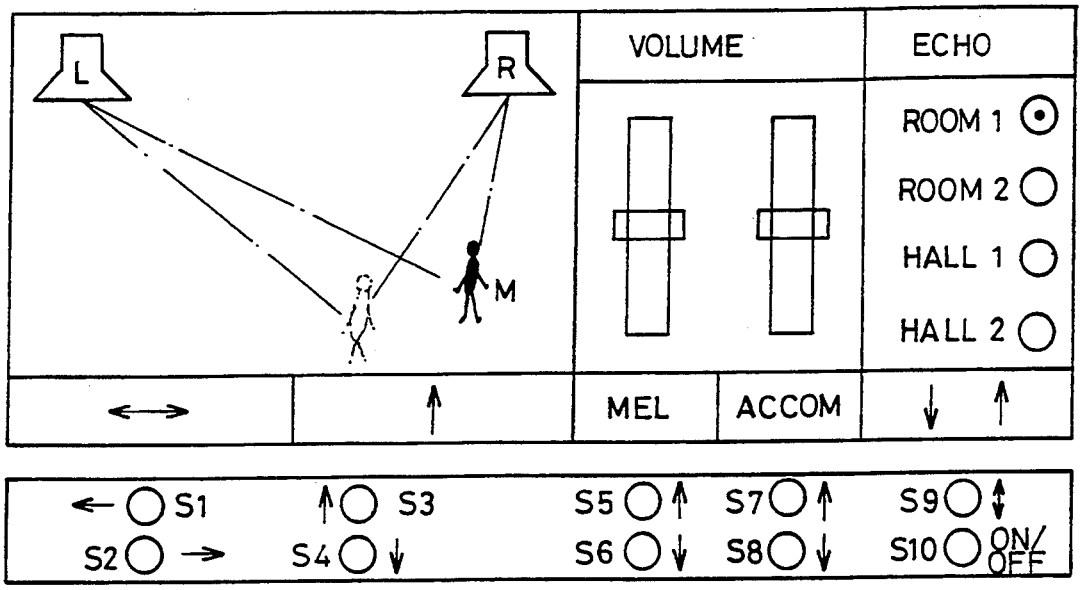
FIG. 2 is a view illustrating a screen state displayed by a display unit in the positional effect sound generation apparatus in FIG. 1.

At this time, if a positional effect function is selected by the function selector 10 according to the user's selection, the position of the listener is displayed on the screen by the display unit 82 under the control of the display controller 81 in response to the control signal from the CPU 40. In this case, as shown in FIG. 2 displayed on the screen are the position of the listener, switches S1-S4 for moving the position of the listener and switches S5-S8 for varying a level of the positional effect sound. The position of the listener is moved to the left by the switch S1, to the right by the switch S2, upward by the switch S3 and downward by the switch S4. As a result, the CPU 40 can check the position of the listener adjacent to the speaker SP on the basis of the operations of the switches S1-S4.

The switches S5-S8 are adapted to select a volume of the positional effect sound with respect to a melody and an accompaniment played by the performer according to a size of a room or a hall.

Figure 3:
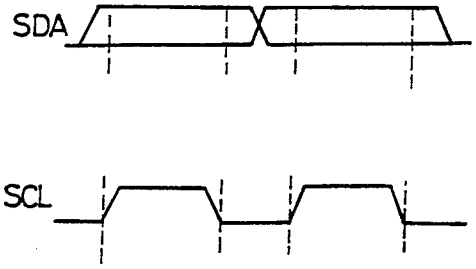
FIGS. 3 and 4 are timing diagrams of a control signal for generation of a positional effect sound in the positional effect sound generation apparatus in FIG. 1.
Figure 4:
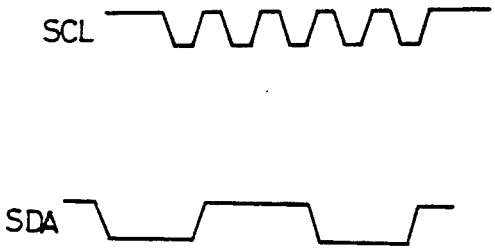

On the other hand, the control signal from the CPU 40 is applied to the positional effect sound generator 90 as shown in FIGS. 3 and 4. In response to the control signal from the CPU 40, the positional effect sound generator 90 applies the various positional effects as shown in FIG. 5 to the output signal from the mixer 70 according to the position of the listener. As a result, the positional effect sound is generated from the positional effect sound generator 90.

The positional effect sound from the positional effect sound generator 90 is amplified by the predetermined level by the amplifier 100 and then outputted through the speaker SP.

As apparent from the above description, according to the present invention, the level and volume of the positional effect sound are adjusted according to the position of the listener. Therefore, the listeners can equally listen to the positional effect sound regardless of their positions.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A positional effect sound generation apparatus for an electronic musical instrument, comprising:

function selection means for selecting at least one of a plurality of functions including a positional effect sound generation function, according to a user's selection;

note sensing means for sensing a note corresponding to a key on a keyboard pushed by a performer;

first storage means for storing a plurality of control signals;

central processing means for selecting at least one of the plurality of control signals in said first storage means corresponding to a function selected by said function selection means and the note sensed by said note sensing means and outputting selected control signals, and transmitting a positional effect sound generation signal in response to the positional effect sound generation function being selected, the positional effect sound generation signal producing different sound effects according to a position of at least one listener listening to the musical instrument;

second storage means for storing a plurality of sound data;

sound generation means for selecting a desired one of the sound data in said second storage means in response to the control signal from said central processing means and generating a sound signal according to the selected sound data;

sound processing means for processing the sound signal from said sound generation means and generating an analog echo effect sound signal;

echo effect sound generation means for generating an echo effect sound based on said analog echo effect sound signal;

mixing means for mixing the sound signal processed by said sound processing means with the analog echo effect sound signal therefrom;

display means for displaying the position of the at least one listener in response to the positional effect sound generation function being selected;

display control means for controlling the display means in response to the positional effect sound generation signal received from said central processing means to display the position of the at least one listener on said display means;

positional effect sound generation means for applying various positional effects to an output signal from said mixing means in response to the positional effect sound generation signal received from said central processing means to generate a positional effect sound; and amplification means for amplifying the positional effect sound from said positional effect sound generation means by a predetermined level and outputting the amplified positional effect sound through a speaker.

2. The positional effect sound generation apparatus of claim 1, further comprising means for varying the position of the at least one listener and inputting a modified position to the central processing means.

3. The positional effect sound generation apparatus of claim 1, further comprising means for varying a volume of at least one of a melody and an accompaniment contained in the positional effect sound.

* * * * *